US006642664B2

(12) United States Patent
Den Engelsen et al.

(10) Patent No.: US 6,642,664 B2
(45) Date of Patent: Nov. 4, 2003

(54) METHOD OF PRODUCING A SCREEN FOR A COLOR DISPLAY TUBE

(75) Inventors: Daniel Den Engelsen, Eindhoven (NL); Ivo Maria Martinus Durlinger, Eindhoven (NL); Hideo Kikuchi, Wakaba-ku (JP); Masaharu Watanabe, Kitasoumagun (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/055,362

(22) Filed: Jan. 23, 2002

(65) Prior Publication Data

US 2002/0192362 A1 Dec. 19, 2002

(30) Foreign Application Priority Data

Mar. 21, 2001 (EP) ..... 01201051

(51) Int. Cl.[7] ..... G09G 3/10; H01J 29/80
(52) U.S. Cl. ..... 315/169.3; 313/402
(58) Field of Search ..... 315/169.1, 169.2, 315/169.3, 169.4; 313/402, 404, 408, 461, 463, 465

(56) References Cited

U.S. PATENT DOCUMENTS 3,953,216 A * 4/1976 Hinata et al. ..... 430/577
5,275,921 A 1/1994 Koizumi et al. ..... 430/326
5,523,114 A * 6/1996 Tong et al. ..... 427/68
5,861,712 A * 1/1999 Beetson et al. ..... 313/442
5,939,821 A * 8/1999 Itou et al. ..... 313/461
6,002,207 A * 12/1999 Beeteson et al. ..... 313/542
6,180,306 B1 * 1/2001 Yoon et al. ..... 430/70
6,310,344 B1 * 10/2001 Shin et al. ..... 250/326
6,348,758 B1 * 2/2002 Kim et al. ..... 313/402
6,441,566 B2 * 8/2002 Shimizu et al. ..... 315/368.15
6,452,320 B1 * 9/2002 New ..... 313/414
6,452,346 B1 * 9/2002 Sluyterman et al. ..... 315/369

FOREIGN PATENT DOCUMENTS

WO WO9934392 7/1999 ..... H01J/29/40

OTHER PUBLICATIONS

Patent Abstract of Japan, Uchiumi Tsutomu, "Method of Forming Fluorescent Film," Publication Number 55028256, Feb. 28, 1980, Application No. 53101117, Aug. 18, 1978.
"Manufacturing of CRTs" by Daniel den Engelsen (SID Seminar Lecture Notes, Long Beach California, May 15 and 19, 2000).

* cited by examiner

*Primary Examiner*—Don Wong
*Assistant Examiner*—Minh D A

(57) ABSTRACT

A screen for a color display tube or display window has a structure of apertures in a black matrix and electroluminescent material in the apertures. Steps in producing the screen include applying the black matrix and the electroluminescent material, and exposing photosensitive material on the display window to light emitted by a light source and passed through a lens system and a shadow mask. The shadow mask is suspended from the display window and the lens system is positioned between the light source and the shadow mask. On the screen, the lens system realizes a microscopic light distribution of the light originating from the light source radiating towards the screen. The photosensitive material includes a bleaching dye functioning as a contrast enhancer in at least one of the process steps.

19 Claims, 6 Drawing Sheets

METHOD OF PRODUCING A SCREEN FOR A COLOR DISPLAY TUBE

BACKGROUND AND SUMMARY

The invention relates to a method of producing a screen having a structure of apertures in a black matrix and electroluminescent material in said apertures, on a display window of a color display tube, which method comprises the process steps of applying the black matrix and the electroluminescent material, in which process steps photosensitive material on the display window is exposed to light emitted by a light source and passed through a lens system and a shadow mask, which shadow mask is suspended from the display window and which lens system is positioned between the light source and the shadow mask, the lens system realizing, on the screen, a microscopic light distribution of the light originating from the light source radiating towards the screen.

The invention further relates to a color display tube and a display window provided with such a screen. Seminar Lecture Notes, Long Beach, Calif., May 15 and 19, 2000). This publication describes a method of applying the black matrix and electroluminescent material on the display window of a color display tube. This familiar way of producing a screen of a color display tube can be summarized by the following description of the major process steps.

First, the black matrix layer is applied. The display window is supplied with a photo resist layer, the mask is inserted and the layer is exposed in three consecutive steps so that all the areas that—in a later process step—will be filled by phosphors are exposed. After removing the mask, the locally hardened dots are developed with water and a layer of graphite is applied. The locally hardened dots are removed by an etching process, resulting in a graphite pattern that leaves open the areas where the phosphors will be applied.

In the second part of the screen producing process, the display window is provided with a photosensitive phosphor suspension layer. Then the shadow mask is inserted and the layer is exposed in such a way that only the areas on the display window that will be provided with a phosphor of a first color are illuminated, thus making the layer insoluble at the exposed locations. After this step, the layer is developed so that only phosphor remains at the proper locations. This process is repeated for the other phosphor colors.

In the present day exposure process, a light source radiates towards the display window and produces a microscopic light distribution behind the apertures of the shadow mask on the display window. The shape of this microscopic light distribution determines the robustness of the exposure process.

New trends in color display tubes, such as real flat tubes and slim tubes—i.e. color display tubes with a larger deflection angle, like for instance 120° or more—make the exposure process much more difficult. Especially for real flat color display tubes provided with gun pitch modulation—as disclosed in EP-A-0968514—the exposure process will become more critical. A critical exposure process leads to lower yields in the production facilities and to color display tubes that show a decrease in picture performance, both by large spreads in the aperture size of the black matrix structure.

It is an object of the invention to overcome the disadvantage of the prior art method by providing a method of producing a screen with an improved response of the photosensitive system to the microscopic light distribution brought about by a more robust exposure process.

According to the invention, this object is achieved by means of a method which is characterized in that the photosensitive material comprises a bleaching dye functioning as a contrast enhancer for at least one of the said process steps.

The invention is based on the insight that the robustness of the exposure process can be significantly improved when the slope of the microscopic light distribution is steeper. This can be achieved by adding a bleaching dye to the photosensitive layer used in the exposure process for applying the black matrix or phosphors. The principle action of a bleaching dye in the exposure process for color display tubes will be described hereinbelow. In the prior art exposure process the microscopic light distribution, which determines the exposed area corresponding to an aperture in the shadow mask has a certain shape, i.e. a peak in the center and a circumferential area having a slope with a certain steepness. Now, when a photosensitive layer with a bleaching dye added to it is exposed to light, generating a microscopic light distribution as described, the bleaching dye will bleach, during the exposure process, as a result of which its transmittance will increase. The microscopic light distribution causes this bleaching process to occur relatively quickly in the center of the exposed area and more slowly towards the edges of the exposed area. Thus, in the course of the exposure process, the average transmittance of the photosensitive layer including the bleaching dye, is higher in the center of the exposed area than in the circumferential areas. This effectively results in a microscopic light distribution with increased steepness, that is with an enhanced contrast, which makes it possible to better define the process levels of the exposure process. This results in a more robust process and a better quality color display tube.

It should be noted that bleaching dyes are known per se; for instance, in U.S. Pat. No. 5,275,921 a bleaching dye is disclosed that is used in the production process of semiconductor elements. This process is totally different from the exposure process for color display tubes. In the pattern forming process of semiconductor elements, the mask used for exposing the photosensitive layer on the substrate is in close contact with the substrate. A problem in this process is formed by the reflections from the substrate. In U.S. Pat. No. 5,275,921, the bleaching dye is used for reducing the reflections from the substrate and to obtain a good contrast between the exposed and unexposed portions of the pattern. For that reason, the bleaching dyes in the semiconductor industry are applied as a separate layer on top of the photosensitive layer.

The use of a bleaching dye in the exposure process for color display tubes is based on its differential effect on the center portion and circumferential portion of the exposed area—that is to say, the area on the display window exposed through an aperture in the shadow mask. This differential effect only occurs because the shape of the microscopic light distribution comes to a peak in the center and gradually slopes down towards the circumferential areas. So, this differential effect has to do with contrast enhancement within the exposed areas, not with improved contrast between exposed and unexposed areas. Preferably, the bleaching dye and the photosensitive material are applied in one process step, because this enables an introduction in the factories without major modifications to the production process. A two-layer system would require additional positions in the production line for applying and drying the bleaching dye. Despite this fact, a two-layer system should not be excluded as being one of the possibilities for contrast enhancement.

In a preferred embodiment, the bleaching dye is added to the photosensitive material for the process step in which the black matrix is applied.

In the manufacture of screens, the black matrix layer is applied first. The apertures in this black matrix structure determine the transmission of the matrix which is directly related to the luminance of the color display tube. The phosphor pattern is applied on top of the black matrix layer, the phosphor dots being somewhat larger than the apertures in the black matrix, in order to compensate for tolerances in the positioning of the phosphor pattern. For this reason, to obtain a high-quality screen a robust process for applying the black matrix is paramount.

A further embodiment is characterized in that the bleaching dye is soluble in water and forms a solution with the photosensitive material.

Most photosensitive materials used for the black matrix process are water-soluble. So, the production process is facilitated when the added bleaching dye forms a solution with the photosensitive material and is also soluble in water.

In a still further embodiment, the bleaching dye comprises a material of the group formed by 1,2-naphthoquinone-(2)-diazide-5-sulphonic acid sodium salt, 1,2-naphthoquinone-(2)-diazide-4-acid sodium salt, 4-diazodiphenylamine hydrogen-sulphate, 1-methyl-4-[2-(4-formylphenyl) ethenyl]pyridinium methosulphate. These four bleaching dyes show good characteristics for use in color display tubes, are water-soluble and are the materials that are preferably used.

A further embodiment is characterized in that the bleaching dye forms an emulsion with the photosensitive material. An alternative way of making a one-layer system consists in combining the photosensitive layer and the bleaching dye into one layer. The particles of the bleaching dye are not dissolved in photosensitive material, but form an emulsion.

In a still further embodiment, the bleaching dye coagulates after the emulsion has dried.

A bleaching dye of this kind has the advantage that, in the manufacturing process, the photosensitive layer and the bleaching dye are applied as a one-layer system, but during the drying process, the bleaching dye starts to coagulate, leading to a separation of the bleaching dye and the photosensitive layer, so that a two-layer system results.

A still further embodiment is characterized in that the time interval needed for the bleaching dye, when exposed to light, to increase its transmittance from 10% to 80% is between 5 and 30 seconds.

In the presently used processes for producing a screen for a color display tube, the time for exposing the photosensitive material is in the order of 10 to 30 seconds. In order to have a bleaching dye that has a differential effect on the central and circumferential areas of the microscopic light distribution, it is recommended to use a bleaching dye that discolorizes at the same rate as the rate needed for the exposure process.

The invention further relates to a color display tube and a display window provided with a screen which is produced using the method of the invention.

BRIEF DESCRIPTION OF THE DRAWING FIGURES

These and other aspects of the invention will be apparent from and elucidated by way of non-limitative examples with reference to the drawings and the embodiments described hereinafter.

Figure 6:
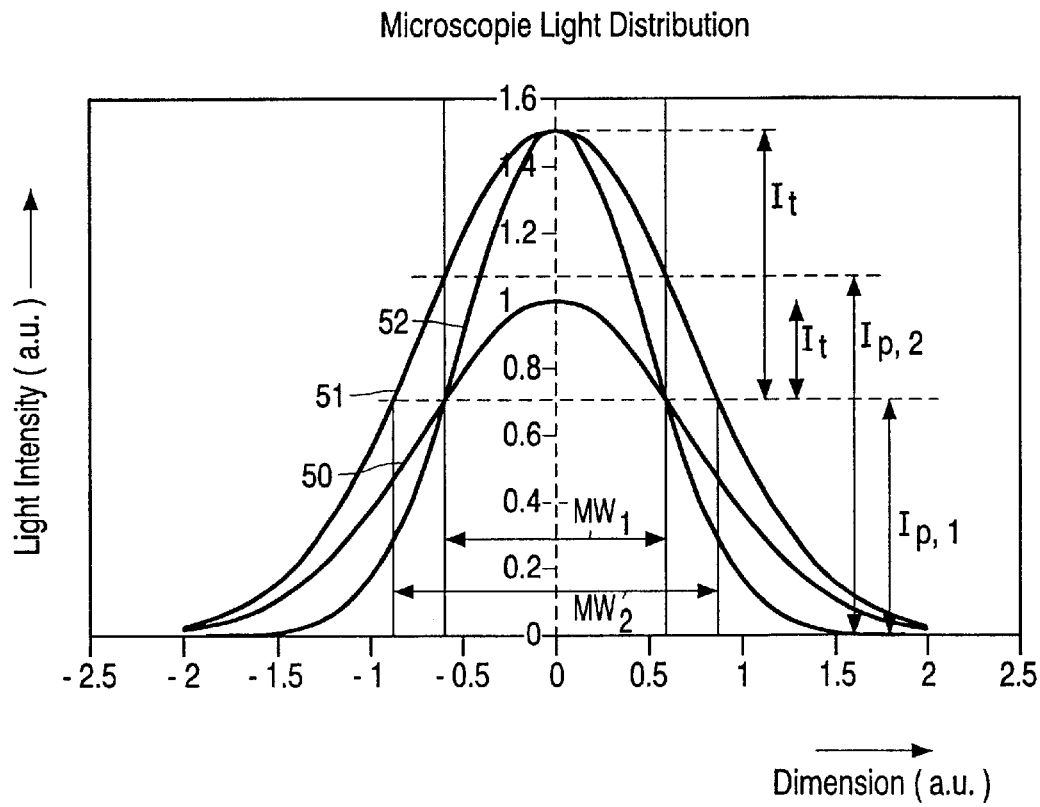
Figure 7:
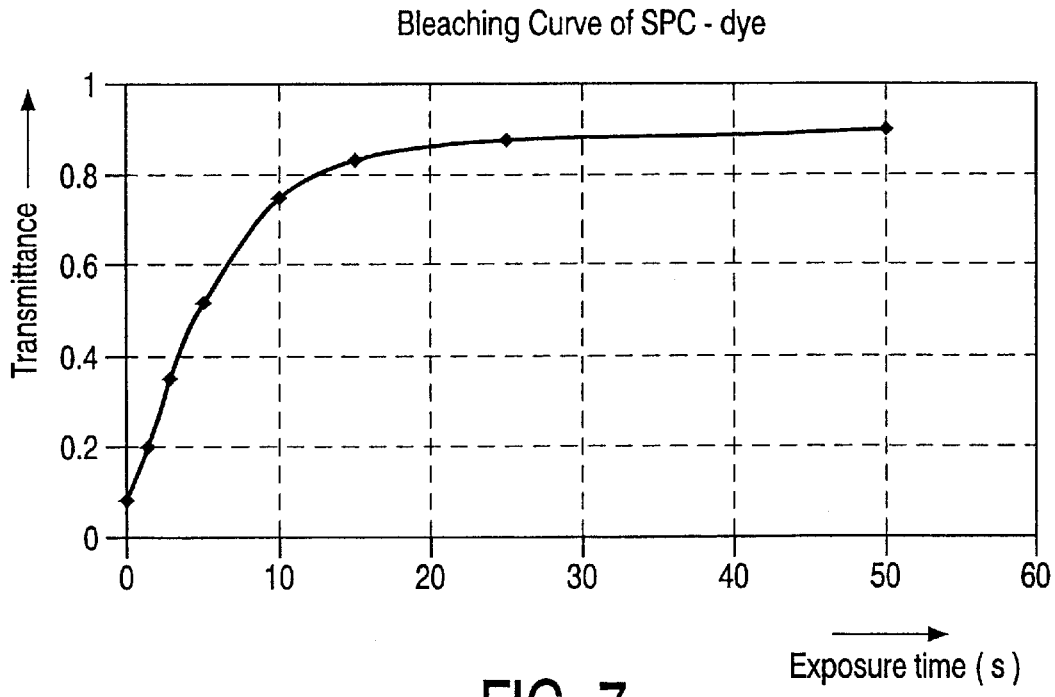
Figure 8:
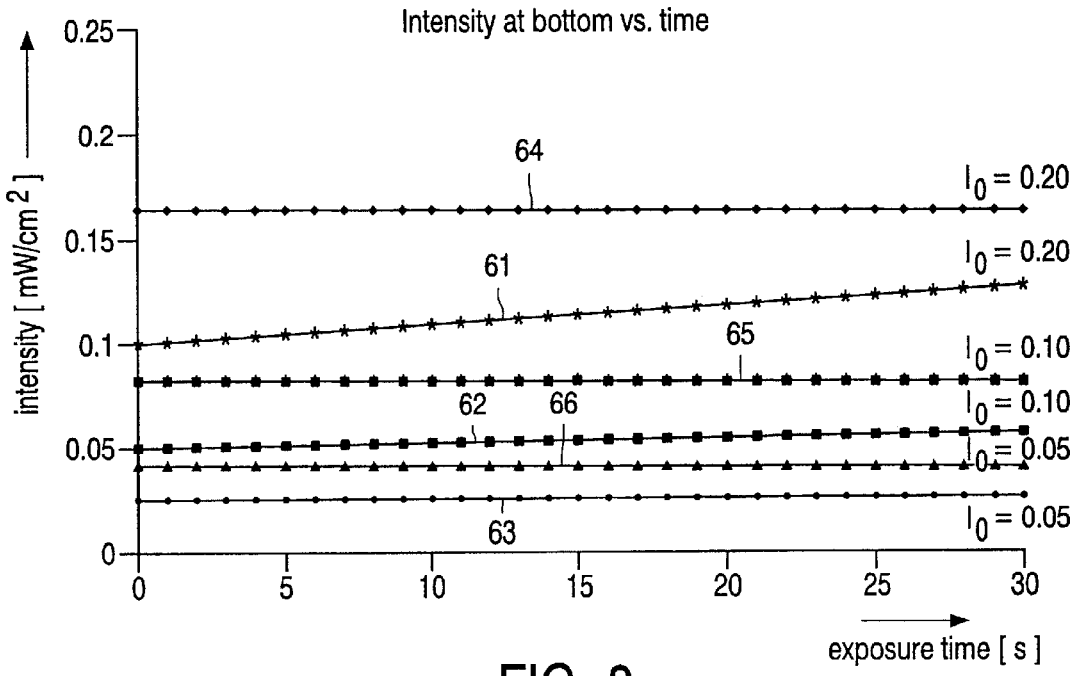
Figure 9:
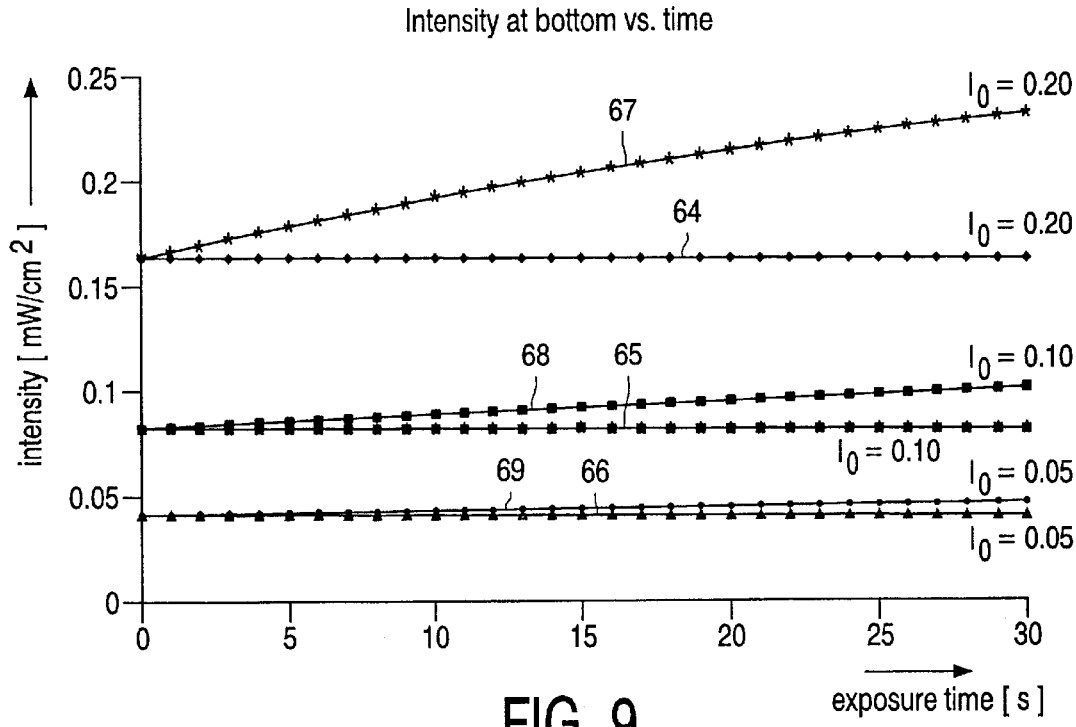

FIG. 6 gives an example of a microscopic light distribution without and with a bleaching dye;

FIG. 7 shows the transmittance of a bleaching dye as a function of time;

FIGS. 8 and 9 show the effect of a bleaching dye on the light intensity at the bottom of the resist layer for different intensity levels.

DETAILED DESCRIPTION

Figure 1:
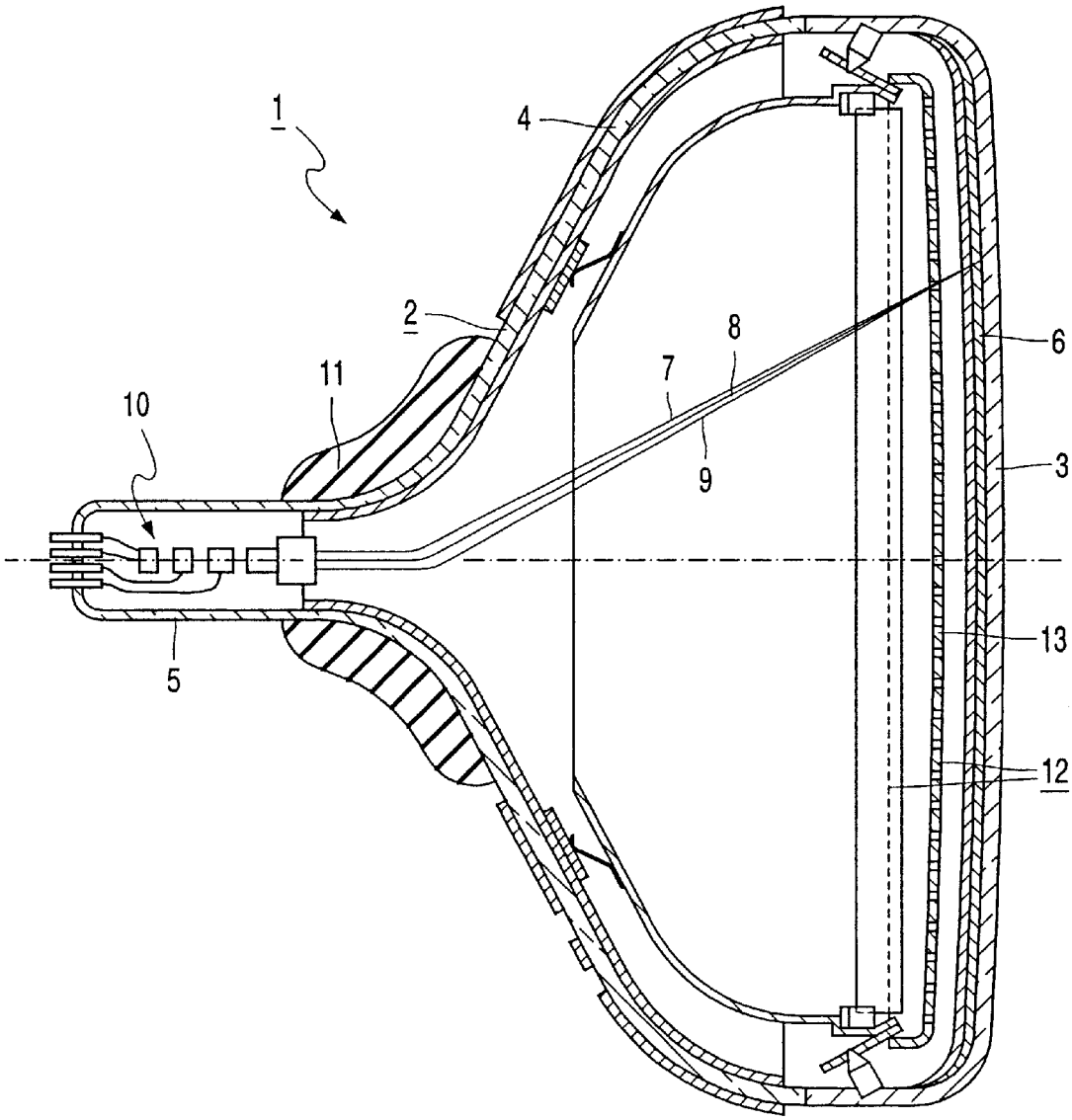
FIG. 1 is a sectional view of a color display tube.

The color display tube 1 shown in FIG. 1 comprises an evacuated glass envelope 2 with a display window 3, a funnel shaped part 4 and a neck 5. On the inner side of the display window 3 a screen 6 having a pattern of for example lines of phosphors luminescing in different colors (e.g. red, green and blue) may be arranged. The phosphor pattern is excited by the three electron beams 7, 8 and 9 that are generated by the electron gun 10. On their way to the screen the electron beams 7, 8 and 9 are deflected by the deflection unit 11 ensuring that the electron beams 7, 8 and 9 systematically scan the screen 6. Before the electrons hit the screen 6 they pass through a color selection electrode 12, which is suspended from the display window 3 and which comprises a shadow mask 13. The shadow mask 13 intersects the electron beams so that the electrons only hit the phosphor of the appropriate color. The shadow mask 13 may be an apertured mask having elongate apertures, or a wire mask.

The screen 6 is generally manufactured by means of a photographic exposure process. In most present day color display tubes 1, the screen 6 has a black matrix structure and the electroluminescent material is applied in the apertures left free by the black matrix. It is also possible to have color display tubes 1 without a black matrix structure.

The black matrix is produced by exposing a photosensitive material that is deposited on the inner side of the display window 3. After the black matrix layer has been applied, another photosensitive process is used for applying the phosphors, in three consecutive production steps for the three colors, to the areas of the display window 3 that were left free by the black matrix structure.

Figure 2:
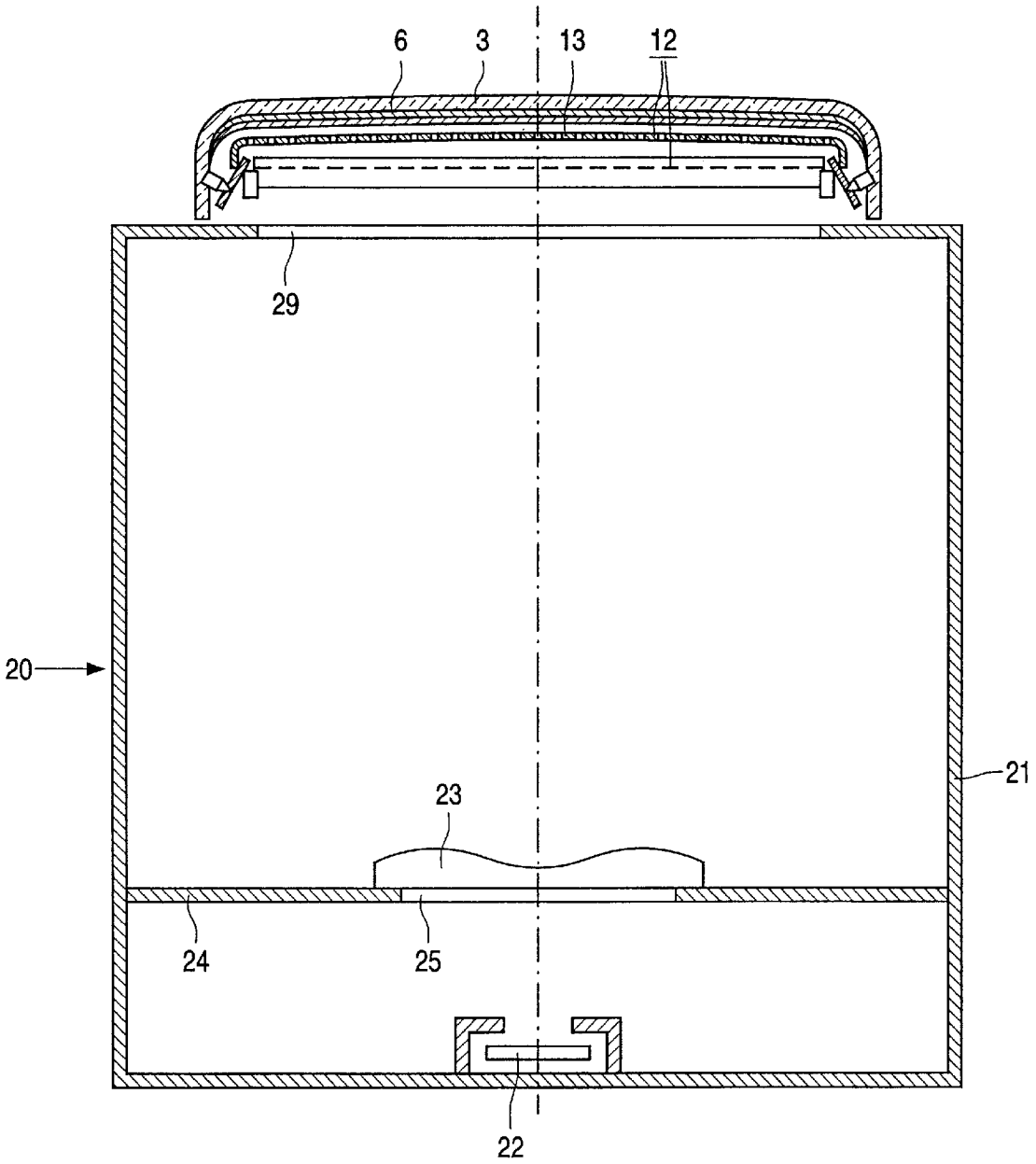
FIG. 2 is a diagrammatic vertical cross-section of a prior art exposure table.

The exposure table 20, as shown in FIG. 2, is the standard equipment for exposing the photosensitive material on the inner side of a display window 3. At the bottom of the housing 21, a light source 22 is positioned. The exposure table 20 is provided with a lens system 23, positioned by a support 24 with an aperture 25. The light from the light source 22 passes through the lens system 23, travels through the aperture 29 in the top of the exposure table 20 and through the shadow mask 13 towards the inner side of the display window 3 in order to expose the photosensitive material.

In the manufacturing process, the lens system 23 simulates the deflection unit 11. When a color display tube 1 is in operation electron beams are deflected across the entire screen 6, hitting the phosphors after having passed the apertures in the shadow mask 13. These trajectories of the electron beams have to be simulated by light beams during the manufacturing process of the screen 6, which is the function of the lens system 23.

Figure 3A:
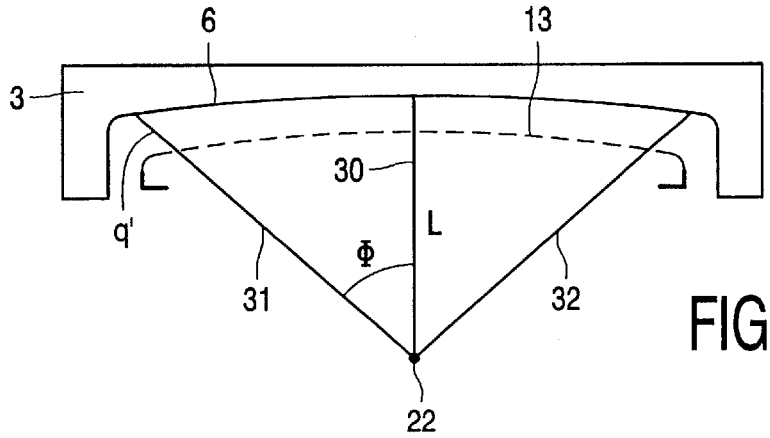
FIGS. 3A and 3B show the effect on mask-to-screen distance for color display tubes with different deflection angles.
Figure 3B:
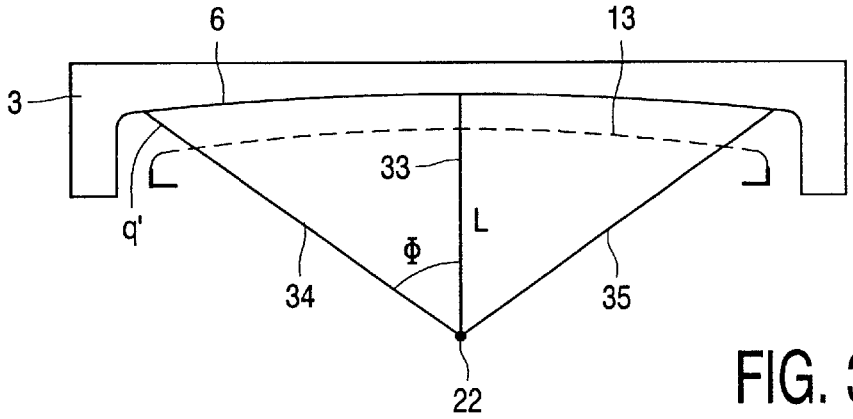
Figure 4:
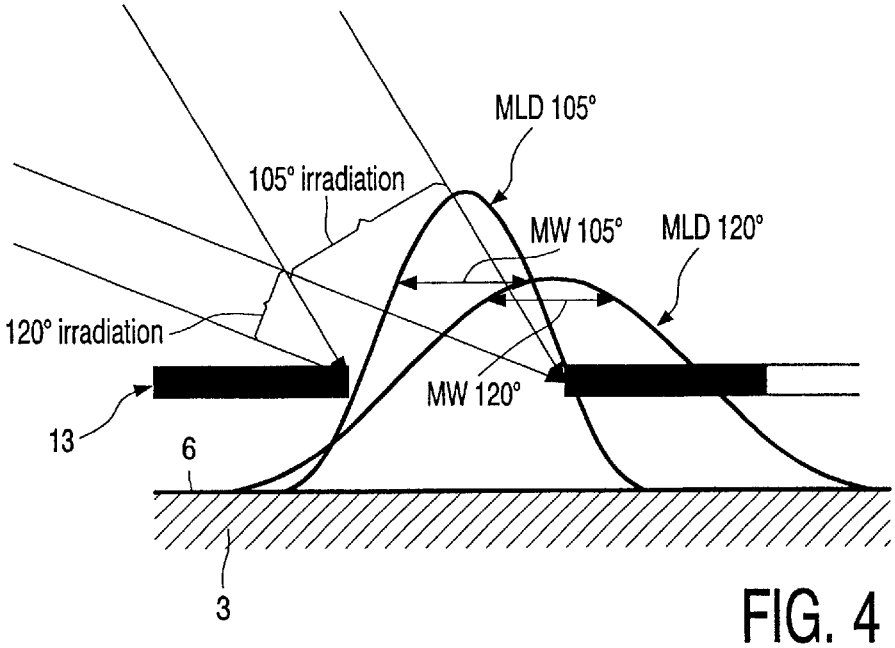
FIG. 4 is a schematic representation of the microscopic light distribution for different deflection angles.

In color display tubes 1 with an increased deflection angle—referred to as slim color display tubes—the exposure process becomes more difficult. This is illustrated in FIGS. 3 and 4. FIGS. 3A and 3B schematically shows what happens to the mask-to-screen distance q' in the direction of the electron beam if the deflection angle Φ is increased. FIG. 3A shows the situation for a color display tube 1 with a standard deflection angle Φ, like for instance 105°, while in FIG. 3B a color display tube 1 is shown with an increased deflection angle Φ, like for instance 120°. In the exposure process for color display tubes 1 with an increased deflection angle Φ, the light source 22 has to be shifted in the direction of the display window 3. The distance L between light source 22 and display window 3 is decreased, causing light beams 34 and 35, which are directed to the peripheral section of the screen 6, to pass the shadow mask 13 at a larger angle compared to the standard color display tube 1 with light beams 31 and 32. It is to be noted that, in the exposure process, light beams represent the trajectories of the electron beams of a color display tube in operation. So, the larger deflection angle Φ, in combination with a certain curvature of the shadow mask 13, leads to an increased mask-to-screen distance q' in the direction of the electron beam.

Furthermore, as is illustrated in FIG. 4, the larger deflection angle Φ leads to a decrease of the effective size of the apertures in the shadow mask 13, due to the thickness of the shadow mask 13 which shadows the light stronger at larger angles.

Because the microscopic light distribution is determined by, amongst others, the light diffraction and the half shadowing of the light source 22, both the enlargement of the mask-to-screen distance q' and the decrease of the effective size of the apertures in the shadow mask 13 make the microscopic light distribution flatter.

In color display tubes 1 provided with gun pitch modulation—as disclosed in EP-A-0968514—the mask-to-screen distance is increased additionally in the peripheral regions, making the exposure process even more critical.

The photosensitive material—also referred to as resist—requires a certain minimum light intensity at which the exposure process starts. This minimum intensity is called the process level. At this level the cross-linking of the polymer molecules in the photosensitive material starts.

For a non-linear resist only the light intensity is of importance; this kind of resist is generally used for the process where the black matrix is applied. Examples of non-linear resists are: PVP-DAS (Polyvinyl pyrrolidone-4, 4'-diazidostilbene-2,2'-disodium sulphonate) and PAD-DAS (Poly-acrylamide co-diacetonamide-4,4'-diazidostilbene-2, 2'-disodium sulphonate). Apart from the chemical composition and the concentration of the photosensitive material, the process level also depends on the layer thickness, the temperature, the humidity and the gas atmosphere during the process in which the black matrix or the phosphors are applied.

Figure 5A:
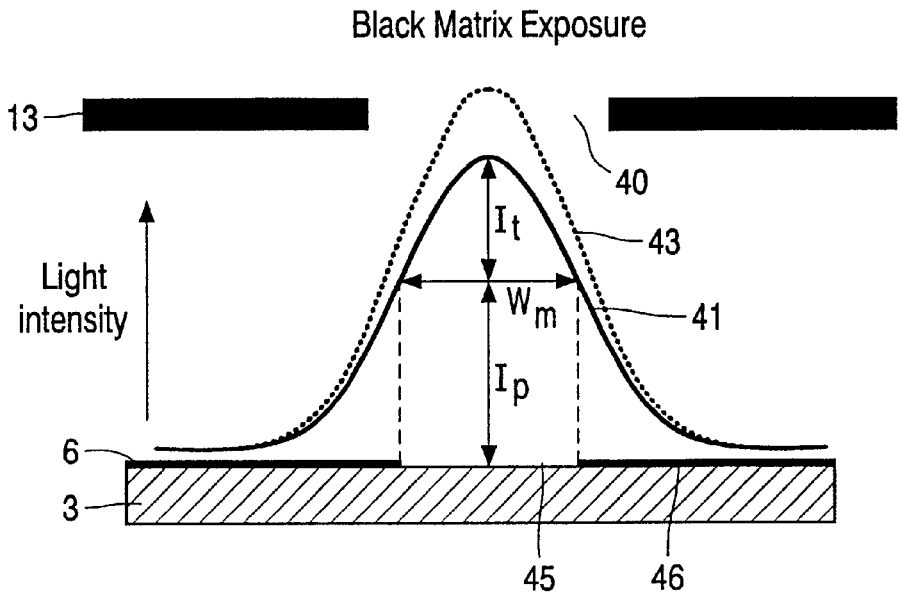
FIGS. 5A and 5B are representations of the microscopic light distribution and the process levels for the black matrix process and the phosphor process.
Figure 5B:
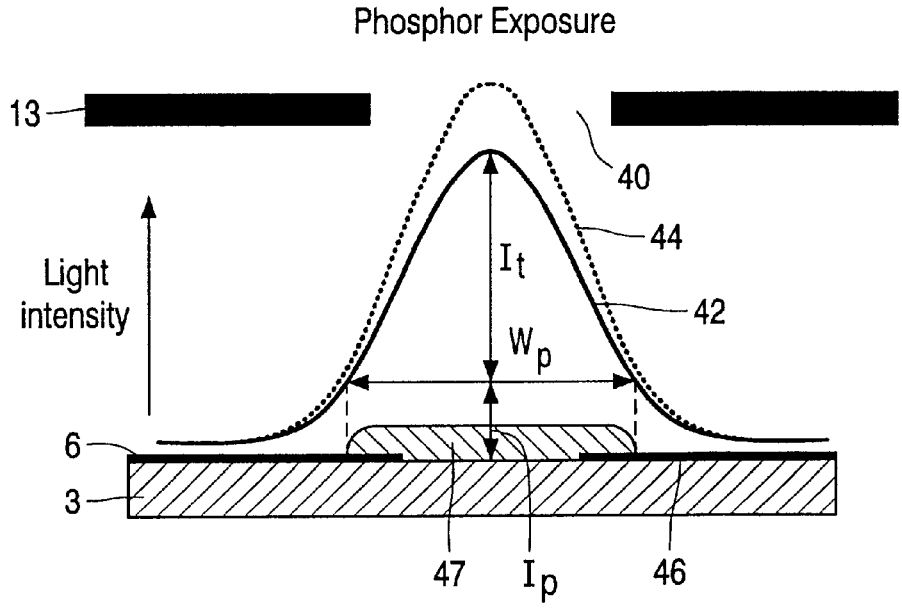

The FIGS. 5A and 5B explain he exposure process for the black matrix and the phosphors, respectively. These Figures show the microscopic light distribution 41, 42 behind an aperture 40 in the shadow mask 13. Normally, the apertures 45 in the black matrix 46 are smaller than the apertures 40 in the shadow mask 13. This means that, given the microscopic light distribution 41, the process level $I_p$ has to be relatively high in the microscopic light distribution 41. The aperture size 45 that is obtained in the black matrix is denoted by $w_m$. After the application of the black matrix 46, the phosphors are applied in accordance with a pattern that gives larger dots 47 than the corresponding apertures 45 in the shadow mask 13. As a result the phosphor pattern overlaps the apertures 45 in the black matrix pattern 46. Tolerances of the phosphor pattern with respect to the black matrix pattern are for that reason not detrimental. In order to obtain a phosphor pattern with a phosphor dot size $w_p$ 47 larger than the aperture size 40 in the shadow mask 13, the process level for the process in which the phosphors are applied has to be relatively low in the microscopic light distribution.

The contrast of the exposure process is defined as the peak intensity divided by the process level, which can be expressed by the formula: $(I_t+I_p)/I_p$. Because the process level for the black matrix process is higher than that for the phosphor process, the contrast of the black matrix process is smaller. Some typical values for the contrast are: 1.5 for the black matrix process and 5 for the phosphor process.

An important parameter to express the capability of the exposure process in a quantitative way is the window growth factor. This window growth factor gives the change of the aperture size of the black matrix when the amount of light is changed; it can be expressed in μm/%, indicating the increase of the aperture size in μm if the light intensity increases one percent, or as a dimensionless number giving, in terms of percentage, the change in aperture size for a one percent change in light intensity. For the phosphor process a dot growth factor can be defined in an analogous way. Evidently, the smaller the window growth factor and dot growth factor, the more robust the exposure process is. Variations in light intensity do not lead to large deviations in the aperture size 45 of the black matrix 46 or in the dot size 47 of the phosphors, and it becomes easier to control these parameters.

The microscopic light distributions 43 and 44, indicated by means of dotted lines in FIGS. 5A and 5B, respectively, show that when the light intensity is increased, the effect on the aperture size 45 of the black matrix is larger than on the dot size 47 of the phosphors. In general, when the process level is higher in the microscopic light distribution, the effect of deviations of the light intensity is larger; or in other words, when the contrast is lower, the robustness of the exposure process becomes less.

In a color display tube 1 with an increased deflection angle and/or gun pitch modulation, the microscopic light distribution becomes flatter. This leads to a lower contrast, because the process level $I_p$ does not change. As a consequence, the window growth factor will increase and the exposure process will become critical.

In order to improve the robustness of the exposure process, it is necessary to increase the contrast, which can be realized by a microscopic light distribution with an increased steepness and consequentially a lower value for the window and/or dot growth factor. This invention discloses a chemical way of increasing the contrast by adding a bleaching dye to the photosensitive material. The principal action of the bleaching dye is determined by the fact that the transmission of the bleaching dye, and hence the transmission of the photosensitive material, increases when it is exposed to luminous radiation. The absorption spectrum of the bleaching dye must preferably be located in the UV region. When the light intensity is higher, the bleaching rate is also higher. The shape of the microscopic light distribution shows a high light intensity in the center and a decreasing light intensity towards the edges. As a result, the bleaching dye will show a stronger bleaching effect in the center and a weaker bleaching effect at the peripheral portions of the apertures in the black windows. This leads to a microscopic light distribution with increased steepness and hence increased contrast.

As quite some light is lost in the photo-bleaching process, the light intensity has to be increased in order to have enough intensity for the irradiation of the resist that determines the black matrix process.

The bleaching process can be further elucidated by means of FIG. 6. In this Figure the microscopic light distribution is given for three situations. The dimensions of the microscopic light distribution and the light intensity are in arbitrary units. The first situation, referred to as standard, and denoted by curve 50 is the microscopic light distribution of the black matrix process where the resist does not contain a bleaching dye. In this situation the process level is $I_{p,1}$ and the aperture size in the black matrix is $MW_1$.

Curve 51 gives the situation without a bleaching dye, but with a 50% increased light intensity with respect to the standard curve 50. When, in this situation, the process level $I_{p,1}$ is left the same, the aperture size in the black matrix $MW_2$ will become larger and this is undesired. So, the process level has be increased to the level $I_{p,2}$ in order to keep the aperture size in the black matrix at the same level $MW_1$. The net result is only an increase of the light intensity, the contrast does not change and the robustness of the exposure process has not increased.

Curve 52 gives the situation wherein a certain bleaching dye is used. In this example, the same aperture size $MW_1$ in the black matrix can be achieved at process level $I_{p,1}$ when the light intensity is increased by 50%. This yields an exposure process with a 50% higher contrast, a steeper slope of the microscopic light distribution and hence a more robust exposure process.

Another important aspect of the bleaching dye is the rate at which it bleaches when exposed to light. Since the bleaching dye has to introduce a differential effect between the center and peripheral portions of the area that is exposed, the bleaching rate has to be more or less the same as the exposure time. If the bleaching rate is such that the bleaching process is much shorter than the exposure time, then the bleaching dye is highly transmitting during the major part of the exposure process, while in the case of a bleaching rate such that the bleaching process is much longer than the exposure time, the bleaching dye is practically only in a low-transmission state. So, a bleaching dye can only work when its transmittance changes significantly during the exposure process. An example of such a bleaching dye is given in FIG. 7, where it is shown that the transmittance of the bleaching dye increases from 10% to 80% in about 20 seconds, i.e. a rate that can be compared with the exposure time in the black matrix process, which is about 30 seconds. The data in FIG. 7 are obtained from T. Yonezawa et al, "Water-soluble Contrast Enhancing Materials—New Photobleachable dyes" (Proc. SPIE Regional Technical Conference on Photo-polymers, Ellenville, N.Y., 183 (1988)). The bleaching dye used for this Figure is an SPC-dye (styrylpyridinium) having a layer thickness of 0.27 $\mu$m and being exposed at a radiation density of 3.3 mW/cm$^2$.

A bleaching dye can be added to the resist several ways. Preferably the bleaching dye is water-soluble, so that it can be mixed with the water-soluble resist of the black matrix process. Such a mixture of resist and bleaching dye enables the standard exposure process to be used in the factories. For this one-layer system, a number of suitable bleaching dyes can be mentioned, like for example: 1,2-naphthoquinone-(2)-diazide-5-sulphonic acid sodium salt, 1,2-naphthoquinone-(2)-diazide-4-sulphonic acid sodium salt, 4-diazodiphenylamine hydrogen-sulphate and 1-methyl-4-[2-(4-formylphenyl)ethenyl]pyridinium methosulphate.

For a two-layer system, in which the bleaching dye is applied on top of the resist, the bleaching dye should be a water-insoluble substance. The application of such a second layer containing the bleaching dye requires at least one extra position in the production line and is not particularly attractive from an industrial point of view. A further possibility is to apply the resist and bleaching dye in the form of an emulsion. This emulsion will coagulate during the drying process of the resist layer and then a two-layer system is formed, which does not require any additional process steps.

The following example, being a simulation, serves to further explain the advantages of adding a bleaching dye to the resist. In this example for the photo-sensitive material, the PVP-DAS resist has been chosen, which is assumed to be UV absorbing but non-bleaching.

In the prior art situation in which a resist without a bleaching dye is used, the following parameters are taken for the UV absorbing resist component DAS:

| | | | |
|---|---|---|---|
| [DAS] | concentration DAS = | 0.2 | [mol/l] |
| $\epsilon_{DAS}$ | extinction coefficient DAS = | 9000 | [l/(mol.cm)] |

Let us assume that a 1 $\mu$m thick resist layer is exposed to an UV-intensity level $I_0$ at the entrance of the resist layer. The intensity of the light source at the bottom of the resist layer (at glass interface) can be calculated by means of the formula:

$$I_h = I_0 \cdot e^{-\epsilon_{DAS} \cdot [DAS] \cdot h} \tag{1}$$

| | | |
|---|---|---|
| $I_h$ | intensity at glass interface | [W/cm$^2$] |
| h | resist layer thickness | [cm] |

With the aforementioned values of $\epsilon_{DAS}$, [DAS] and h, the intensity at the glass surface is:

$$I_h = 0.84 I_o \tag{2}$$

For a resist layer to which a bleaching dye has been added according to the invention, the formula for the intensity has to be modified. The bleaching dye will show an increasing transmittance during the exposure process, which is dependent on the intensity of the light source and the transmittance of the bleaching dye itself. The x-coordinate measures the distance in the resist layer: x=0 at the entrance of the resist layer and x=h at the end—that is at the resist-glass interface—of the resist layer. The decomposition of the bleaching agent can be described by $$-\frac{d[B]_{x,t}}{dt} = \alpha \cdot \lambda \cdot \phi_B \cdot \varepsilon_B \cdot [B]_{x,t} \cdot I_{x,t} \tag{3}$$

| | | |
|---|---|---|
| $[B]_{x,t}$ | concentration bleaching agent | [mol/l] |
| $\alpha$ | constant = 83.488 | [mol.cm$^2$/(W.s.l)] |
| $\lambda$ | wavelength = 0.365 $10^{-4}$ | [cm] |
| $\phi_B$ | quantum-efficiency of bleaching agent | [−] |
| $\epsilon_B$ | extinction coefficient of bleaching agent | [l/(mol.cm)] |
| $I_{x,t}$ | UV-intensity | [W/cm$^2$] |

The UV-intensity at the bottom of the resist layer follows from $$I_{h,t} = I_0 \cdot e^{-\int_0^h (\varepsilon_{DAS} \cdot [DAS] + \varepsilon_B \cdot [B]_{x,t}) \cdot dx} \tag{4}$$

The integral in this expression is needed because [B] decreases from top to bottom in the resist layer. For simplicity, the PVP-DAS resist is assumed to be non-bleaching, $\epsilon_{DAS} \cdot$[DAS] is constant in time. With formulas (3) and (4) the intensity at the glass-interface can be calculated as a function of time.

In FIG. 8, the effect of bleaching is shown. The intensity at the bottom of the layer versus exposure time is plotted for three intensity levels $I_0$ (0.20, 0.10 and 0.05 mW/cm$^2$). The lines 61, 62, 63 show the behavior of the resist with a bleaching dye, while lines 64, 65, 66 show said behavior of a resist without a bleaching dye. For the bleaching dye, the following properties are (arbitrarily) chosen:

| | | |
|---|---|---|
| $[B]_{x,0}$ = | 0.05 | [mol/l] |
| $\phi_B$ = | 0.5 | [−] |
| $\epsilon_B$ = | 100000 | [l/(mol.cm)] |

In this example of an exposure process with a bleaching dye added to the resist layer, the intensity at the bottom of the layer increases (almost) linearly in time. The UV intensity at the bottom of the layer that is available for cross-linking is decreased by (the necessary) UV absorption of the bleaching dye.

If the intensity $I_0$ for the system with a bleaching dye is increased to get a UV-intensity at the bottom of the layer (i.e. at the glass interface), at t=0, that is equal to the system without a bleaching agent, the lines 61, 62 and 63 from FIG. 8 are changed to the lines 67, 68 and 69 as shown in FIG. 9.

From the formulae (3) and (4) it can be learnt that, a high quantum-efficiency of the bleaching agent is beneficial for obtaining a good bleaching effect. Furthermore, higher concentrations of the bleaching dye make it more effective, but the UV-intensity at the bottom of the layer (available for cross linking) decreases. Also, when the extinction coefficient is increased, bleaching becomes more effective, but at the cost of the UV intensity. So, in both situations, the UV intensity at the entrance of the resist layer has to be increased.

Summarizing, in the manufacturing process of a screen 6, for use in a color display tube 1, a photosensitive process step, referred to as the exposure process, is used for applying the black matrix pattern and the phosphor layers to the display window to form the screen 6. The robustness of this exposure process is dependent on, amongst others, the shape of the microscopic light distribution on the display window 3. It appears that in color display tubes 1 with an increased deflection angle or in tubes with a real flat outer surface, the exposure process becomes more and more critical. According to the invention, this problem can be overcome by adding a bleaching dye to the photo-sensitive material used for the exposure process. This bleaching dye acts more strongly in the center of the microscopic light distribution than in the peripheral portions. As a result, the slopes of the microscopic light distribution become steeper, and the contrast in the exposure process is increased, thus making said process a lot more robust.

What is claimed is:

1. A method of producing a screen having a structure of apertures in a black matrix and electroluminescent material in said apertures, on a display window of a color display tube, comprising process steps of applying the black matrix and the electroluminescent material, in which process steps photosensitive material on the display window is exposed to light emitted by a light source and passed through a lens system and a shadow mask, which shadow mask is suspended from the display window and which lens system is positioned between the light source and the shadow mask, the lens system realizing, on the screen, a microscopic light distribution of the light originating from the light source radiating towards the screen, wherein the photosensitive material includes a bleaching dye functioning as a contrast enhancer for at least one of the process steps.

2. The method of claim 1, wherein the bleaching dye is added to the photosensitive material for the process step in which the black matrix is applied.

3. The method of claim 2, wherein the bleaching dye is soluble in water and forms a solution with the photosensitive material.

4. The method of claim 2, wherein the bleaching dye includes a material of the group formed by 1,2-naphthoquinone-(2)-diazide-5-sulphonic acid sodium salt, 1,2-naphthoquinone-(2)-diazide-4-sulphonic acid sodium salt, 4-diazodiphenylamine hydrogen-sulphate, 1-methyl-4-[2-(4-formylphenyl) ethenyl]pyridinium methosulphate.

5. The method of claim 2, wherein the bleaching dye forms an emulsion with the photosensitive material.

6. The method of claim 2, wherein the time interval needed for the bleaching dye, when exposed to light, to increase its transmittance from 10% to 80% is between 5 and 30 seconds.

7. The method of claim 1, wherein the bleaching dye is soluble in water and forms a solution with the photosensitive material.

8. The method of claim 7, wherein the bleaching dye includes a material of the group formed by 1,2-naphthoquinone-(2)-diazide-5-sulphonic acid sodium salt, 1,2-naphthoquinone-(2)-diazide-4-sulphonic acid sodium salt, 4-diazodiphenylamine hydrogen-sulphate, 1-methyl-4-[2-(4-formylphenyl)ethenyl]pyridinium methosulphate.

9. The method of claim 7, wherein the time interval needed for the bleaching dye, when exposed to light, to increase its transmittance from 10% to 80% is between 5 and 30 seconds.

10. The method of claim 1, wherein the bleaching dye includes a material of the group formed by 1,2-naphthoquinone-(2)-diazide-5-sulphonic acid sodium salt, 1,2-naphthoquinone-(2)-diazide-4-sulphonic acid sodium salt, 4-diazodiphenylamine hydrogen-sulphate, 1-methyl-4-[2-(4-formylphenyl)ethenyl]pyridinium methosulphate.

11. The method of claim 1, wherein the bleaching dye forms an emulsion with the photosensitive material.

12. The method of claim 11, wherein the bleaching dye coagulates after the emulsion has dried.

13. The method of claim 11, wherein the time interval needed for the bleaching dye, when exposed to light, to increase its transmittance from 10% to 80% is between 5 and 30 seconds.

14. The method of claim 1, wherein the time interval needed for the bleaching dye, when exposed to light, to increase its transmittance from 10% to 80% is between 5 and 30 seconds.

15. A color display tube or display window, provided with a screen having a structure of apertures in a black matrix and electroluminescent material in said apertures, which screen is produced by a method comprising:

applying the black matrix and the electroluminescent material; and exposing photosensitive material on the display window to light emitted by a light source and passed through a lens system and a shadow mask, which shadow mask is suspended from the display window and which lens system is positioned between the light source and the shadow mask, the lens system realizing, on the screen, a microscopic light distribution of the light originating from the light source radiating towards the screen, wherein the photosensitive material includes a bleaching dye functioning as a contrast enhancer.

16. The color display tube or display window of claim 15, wherein applying the black matrix includes adding the bleaching dye to the photosensitive material.

17. The color display tube or display window of claim 15, wherein the bleaching dye is soluble in water and forms a solution with the photosensitive material.

18. The color display tube or display window of claim 15, wherein the bleaching dye includes a material of the group formed by 1,2-naphthoquinone-(2)-diazide-5-sulphonic acid sodium salt, 1,2-naphthoquinone-(2)-diazide-4-sulphonic acid sodium salt, 4-diazodiphenylamine hydrogen-sulphate, 1-methyl-4-[2-(4-formylphenyl) ethenyl]pyridinium metho-sulphate.

19. The color display tube or display window of claim 15, wherein the bleaching dye forms an emulsion with the photosensitive material.

* * * * *